United States Patent [19]

Ito et al.

[11] Patent Number: 4,610,937

[45] Date of Patent: Sep. 9, 1986

[54] PRODUCT OF AND PROCESS FOR PREPARING ZN-NI-ALLOY-ELECTROPLATED STEEL SHEETS EXCELLENT IN CORROSION RESISTANCE

[75] Inventors: Takehiko Ito, Tokyo; Taisuke Irie; Yoshitaka Nakagawa, both of Osaka; Koichi Watanabe, Hyogo, all of Japan

[73] Assignee: Nisshin Steel Company, Tokyo, Japan

[21] Appl. No.: 555,711

[22] Filed: Nov. 28, 1983

[51] Int. Cl.[4] ..... C25D 3/56; C25D 5/26; C25D 5/50

[52] U.S. Cl. ..... 428/659; 204/27; 204/37.1; 204/44.2; 420/513; 420/514

[58] Field of Search ..... 204/44.2, 27, 37.1; 428/658, 659; 420/513, 514

[56] References Cited

PUBLICATIONS

Abner Brenner, "Electrodeposition of Alloys", vol. II, pp. 183–190, (1963).

*Primary Examiner*—G. L. Kaplan

*Attorney, Agent, or Firm*—Webb, Burden, Robinson & Webb

[57] ABSTRACT

Zn-Ni-alloy electroplating of steel sheets is carried out using a plating bath containing 10–40 g/l zinc, 15–160 g/l nickel, 0.1–5 g/l cobalt and 0.2–10 g/l titanium and 0.1–5 g/l aluminum or 0.1–5 g/l magnesium existing in the form of salts, the pH of which is 1.5–2.5. The obtained plated product exhibits improved excellent corrosion resistance and corrosion peeling resistance. The product can be subjected to heating to 60°–200° C., preferably in hot water, steam, or atomized water mist. This treatment further increases corrosion resistance.

15 Claims, 1 Drawing Figure

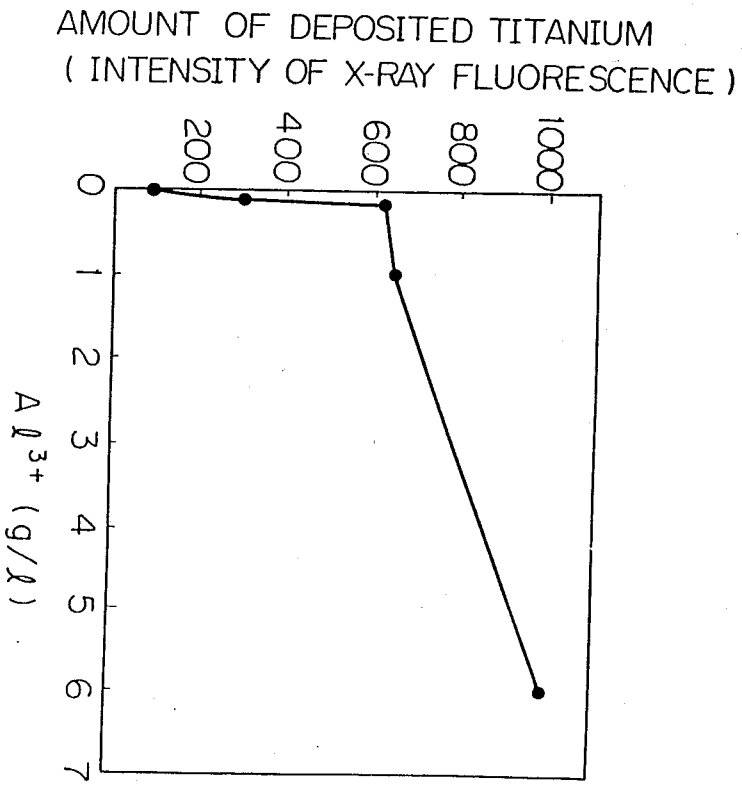
AMOUNT OF DEPOSITED TITANIUM
( INTENSITY OF X-RAY FLUORESCENCE )
1000
800
600
400
200
0
1
2
3
4
5
6
7
Aℓ3+ (g/ℓ)

PRODUCT OF AND PROCESS FOR PREPARING ZN-NI-ALLOY-ELECTROPLATED STEEL SHEETS EXCELLENT IN CORROSION RESISTANCE

TECHNICAL FIELD OF THE INVENTION

This invention relates to a process for preparing Zn-Ni-alloy-electroplated steel sheets excellent in corrosion resistance.

BACKGROUND OF THE INVENTION

Zinc-electroplated steel sheets have good appearance and high corrosion resistance, and therefore they are widely used for various purposes. Usually the corrosion resistance of the plated layer is improved by formation of chemical conversion coatings.

The formation of chemical conversion coatings has been effected with chromate type or phosphate type chemical conversion solutions. Attempts have been made to improve these chemical conversion solutions by modifying the compositions thereof. However, it is difficult to obtain dense and uniform coatings excellent in corrosion resistance by chemical conversion. Chemical conversion coatings are susceptible to abrasion and scratching regardless of how they are improved, and plated layers are often exposed as the result thereof. Therefore, improvement in corrosion resistance by means of chemical conversion has its limit.

Recently there have been into use methods for improving the corrosion resistance of the plated zinc layer per se by forming a zinc layer containing an ingredient or ingredients other than zinc which enhance corrosion resistance. A typical example is Zn-Ni-alloy electroplating.

The Zn-Ni-alloy-electroplated layers which have been developed so far contain as high as 8–16% by weight of expensive nickel and therefore, the cost of the plated layer is about twice that of the conventional Zn-electroplated layer of the same coating weight. In order that Zn-Ni-alloy-electroplated layers can exhibit their intrinsic corrosion resistance, that is, to achieve corrosion resistance 4–6 times as high as that of the conventional zinc-electroplated layers, it is necessary to provide a thick plating as no less than 30 g/m$^2$ or more (on one side), which is very thick as electroplating. If only stable corrosion resistance is wanted, the coating weight of at least 20 g/m$^2$ per side is required, and it does not follow that the coating weight can be reduced simply because less corrosion resistance is required. Therefore, the cost of plating is remarkably higher than with the conventional zinc electroplating. The reason why formation of plated layers as thick as 30 g/m$^2$ (one side) is required in order to realize the intrinsic corrosion resistance of the layer is that no dense corrosion product which exhibits high corrosion resistance is formed on the surface of the plated layer until the plated layer is considerably corroded. If the coating weight is less than 30 g/m$^2$ (one side), the plated layer remaining as a metal after the corrosion product has been formed is too thin, and thus it cannot maintain corrosion resistance for a long period of time because of loss of the corrosion product. Also, if the coating weight is less than 30 g/m$^2$ (one side), generation of pin holes is remarkable and corrosive liquid reaches the substrate steel through the pin holes and develops corrosion at the interface between the steel substrate and the plated layer resulting in peeling of the plated layer. This phenomenon is called "corrosion peeling" of the plated layer and is a serious defect of conventional Zn-Ni-alloy-electroplated steel sheets. Steel sheets electroplated with a Zn-Ni alloy at the coating weight of 20 g/m$^2$ (one side) develop fatal corrosion peeling to such an extent that the plated layer easily peels off in an adhesive tape peel-off test after being exposed to an atmosphere of 70° C. and 98% relative humidity for 96 hours.

Although corrosion peeling can be considerably prevented by chromate treatment after plating, this if far from a complete solution. Further, once plated sheets are chromate-treated, phosphate treatment can no longer be properly effected, which means that the plated sheets can be used only for limited applications.

It is known that Zn-Ni-alloy-plated layers which contain a small amount of titanium have better corrosion resistance (Japanese Laying Open Patent Publication No. 104194/83). Titanium is added to the plating bath in the form of titanium salt (sodium or potassium titanium fluoride, otherwise called sodium or potassium hexafluorotitanate, for example). But it is difficult to cause a significant amount of titanium to codeposit in a Zn-Ni-alloy electroplated layer.

The reason is surmised to be that titanium exists in the plating bath in the form of negative complex ions and therefore does not easily undergo hydrolysis.

We tried to develop Zn-Ni-alloy-electroplated steel sheets which exhibit very stable high corrosion resistance with a coating weight of less than 30 g/m$^2$ and we found that the corrosion resistance of plated layers can be remarkably improved by causing cobalt and aluminum or magnesium in addition to titanium to codeposit in the plated layer. We also found that corrosion resistance of the above-mentioned plated layer can be further improved by heating the electroplated steel sheets in an atmosphere of 60°–200° C.

On the basis of these findings, we further searched for a balanced composition which enhances corrosion resistance and prevents generation of pin holes, and we succeeded in completing this invention.

DISCLOSURE OF THE INVENTION

We have found that a plated layer comprising an alloy essentially consisting of 8–16% by weight nickel, 0.005–1% by weight titanium, 0.01–0.5% by weight cobalt, 0.001–2% by weight aluminum and the balance zinc, or 8–16% by weight nickel, 0.005–1% by weight titanium, 0.05–0.5% by weight cobalt, 0.001–1% by weight magnesium and the balance zinc is markedly superior to the conventional Zn-Ni alloy in bare corrosion resistance and corrosion peeling resistance.

This invention provides a process for preparing zinc-alloy-electroplated steel sheets excellent in corrosion resistance having the above-mentioned composition comprising electroplating steel sheets with an acidic plating bath containing 10–40 g/l (gram as atom per liter bath) zinc, 15–160 g/l nickel, 0.2–10 g/l titanium, 0.1–5 g/l cobalt and 0.1–5 g/l aluminum or 0.2–4 g/l magnesium, the pH of which is 1.5–2.5.

Of course, metals exist in the plating bath in the form of ions, but they do not always exist in the form of simple metallic ions. So simply names of metals are referred to in this specification. It should be understood that metals are added to the plating bath in the form of a salt.

Corrosion resistance of steel sheets electroplated in accordance with the above-mentioned process is further improved by heating the plated sheets in an atmosphere of 60°-200° C.

This invention is characterized by (1) incorporating aluminum or magnesium in addition to titanium in the plated layer for improvement of corrosion resistance and further incorporating cobalt for prevention of generation of pin holes, and preferably (2) heating the plated sheets in order to seal any pin holes which might be generated in spite of the addition of cobalt.

Titanium has excellent corrosion resistance per se, and it improves the corrosion resistance of Zn-Ni alloys when incorporated therein. In the case of titanium-containing plating baths which give plated layers containing 8-16% nickel, however, only a very slight amount of titanium is codeposited. Moreover, the amount of codeposited titanium fluctuates and, therefore, it is impossible to obtain products with uniform corrosion resistance. In this invention, aluminum or magnesium is added to the plating bath to increase codeposition of titanium and to stabilize the corrosion resistance of the products. Addition of aluminum or magnesium to the plating bath enhances the amount of codeposited titanium in the plated layer.

The reason why aluminum or magnesium increases codeposition of titanium is thought to be that aluminum ions or magnesium ions promote hydrolysis of the titanium complex at the surface where electrodeposition occurs.

X-ray fluorescence analysis of the plated layers produced when aluminum was added and the above-mentioned compound was used as the titanium source revealed codeposition of sodium or potassium as well as aluminum in addition to titanium. In the same way, deposition of sodium or potassium as well as magnesium was recognized in addition to titanium when magnesium was added. From these facts, it is surmised that the deposited titanium is a hydrolysis product comprising titanium, metallic ion metals added for enhancement of deposition of titanium, and cation metals of the added titanium compound.

In the invention of this application, titanium is codeposited in the Zn-Ni-alloy-electroplated layer by the above-described procedures, that is, 0.005-1% by weight titanium is codeposited by the addition of aluminum or magnesium to the plating bath. The plated layer formed in accordance with this invention exhibits excellent bare corrosion resistance with remarkably less corrosion weight loss than that of conventional Zn-Ni-alloy-electroplated layers.

Although generation of pin holes is reduced by the increase in codeposition of titanium to lower than in conventional Zn-Ni-alloy-electroplating, it is still impossible to completely inhibit generation of pin holes, and thus the corrosion peeling resistance is not so remarkably improved. In order to improve this, it is designed that cobalt is contained in the plated layer in an amount of 0.01-0.5%.

In the invention of this application, pin holes, which would be generated in spite of the above-mentioned measures for preventing generation thereof, can be sealed by heating the plated sheets. Heating can be effected in any gaseous, liquid or atomized mist atmosphere. But heating in hot water, steam or atomized water mist atmosphere is preferred. It is necessary to heat the plated sheets to a temperature not lower than 60° C., but no further sealing effect is obtained at temperatures over 200° C. Heating for up to 60 seconds will suffice.

Sealing of pin holes by heating is effected by hydrolysis of codeposited titanium complexes remaining undecomposed. It is surmised that the hydrolysis product fills the holes. This is effective only in plated layers containing titanium, and especially effective in plated layers containing an increased amount of titanium by addition of aluminum or magnesium to the plating bath in accordance with this invention. The sealing effect is not exhibited at temperatures lower than 60° C., probably hydrolysis will not occur at such low temperatures.

It is possible to add substance which increase the sealing effect such as phosphate salts or chromate salts to the water used for the sealing treatment.

As sources of elements constituting the plating bath of this invention, various compounds can be used. As the titanium source, titanium tartarate, titanium oxalate, sodium titanate fluoride, potassium titanium fluoride, etc. can be used, but the latter two are preferred because of their chemical stability in the bath. As the source of aluminum or magnesium ions, chloride, sulfate, nitrate, acetate, etc. thereof can be used but inexpensive easily available aluminum sulfate and magnesium sulfate are preferred. For zinc, nickel and cobalt sources, chloride, sulfate, nitrate and acetate thereof can be used, but sulfates are advantageously used.

The additives for increasing codeposition of titanium are not limited to aluminum and magnesium. Chemical species having the same effect such as iron ions or boron ions can be employed.

In this invention, it is intended that 8-16% by weight nickel be deposited in the plated layer. This is the deposition range of nickel which exhibits excellent corrosion resistance. In order to obtain a Zn-Ni alloy layer in this range by electroplating, the plating bath should contain 10-40 g/l zinc and 15-160 g/l nickel. At concentrations lower than the lower limits, the amounts of zinc and nickel ions are small in comparison with the amounts consumed for deposition and change in the amounts of zinc and nickel ions in the bath is large and it is difficult to effect constant deposition of zinc and nickel in the above-mentioned ranges all the time. In the range in excess of the upper limit, although the nickel amount in the plated layer is 8-16% on the average, non-uniformity in composition of the plated layer is caused. Also it is not economical to maintain such a high nickel content in a plating bath. The preferable nickel content range is 20-60 g/l and the more preferred range is 30-50 g/l. The preferable zinc content range is 12-25 g/l and the more preferred range is 13-21 g/l.

The titanium content of the plating bath should be 0.2-10 g/l. At a concentration lower than the lower limit, it is difficult to codeposit titanium even though the bath contains titanium. When the titanium content is in excess of 10 g/l, dissolution of the titanium compound becomes difficult. Also titanium in the bath becomes unstable under such a high concentration of titanium and becomes susceptible to hydrolysis. The preferred content is 1-8 g/l, and the more preferred content is 3-7 g/l.

The content of aluminum or magnesium should be 0.1-5 g/l and 0.2-4 g/l respectively. The effect of aluminum and magnesium to increase codeposition of titanium is not exhibited at concentrations lower than said lower limit. On the other hand, when aluminum concentration is in excess of 5 g/l, precipitate containing titanium ions and aluminum ions is formed at the initial make-up of the plating bath, that is, the stability of the bath is impaired. In the case of magnesium ions, when the magnesium concentration is in excess of 4 g/l, patterns caused by local flow in the plating bath appear on the surface of the plated layer, which degrades the appearance of the product. The preferred concentration is 0.15–3 g/l for aluminum and 0.3–3 g/l for magnesium. The more preferred concentration is 0.2–2 g/l for aluminum and 0.5–2 g/l for magnesium.

The cobalt content should be 0.1–5 g/l. On the other hand the effect of cobalt is not exhibited at concentrations less than 0.1 g/l. The effect saturates at 5 g/l and there is no advantage if the concentration is in excess of 5 g/l. The preferred range is 0.5–3 g/l, the more preferred range is 1–2 g/l.

The pH of the plating bath should be 1.5–2.5. If the bath is strongly acidic such as less than 1.5 of pH, zinc is deposited preferentially to nickel. Under this condition, a large amount of expensive nickel must be retained dissolved in the bath all the time in order that a plated layer containing 8–16% nickel be deposited. On the other hand, if the pH of the bath is higher than 2.5, a deposit containing more than 16% nickel partially occurs and formation of a uniform plated layer becomes difficult, which results in deterioration in corrosion resistance and corrosion peeling resistance of the product. Therefore, the pH of the plating bath must be adjusted to 1.5–2.5.

In carrying out the process of this invention, the employed current density should be 5 A/dm$^2$–150 A/dm$^2$. Balanced deposition of a plurality of chemical species are effected in this range. If the current density is less than 5 A/dm$^2$, the nickel content of the plated layer will exceed 16%. On the contrary, at the current density in excess for 150 A/dm$^2$, higher voltage is required, which will invite economic loss.

The preferred current density range is 10–100 A/dm$^2$. The more preferred range is 20–80 A/dm$^2$.

The invention will be illustrated by way of experimental work and working examples with reference to the attached drawing.

BRIEF EXPLANATION OF THE ATTACHED DRAWING

The sole drawing attached is a diagram showing the relation between the amount of aluminum added to a plating bath containing 20 g/l potassium titanium fluoride and the amount of codeposited titanium in the plated layer indicated as intensity of X-ray fluorescence.

DESCRIPTION OF EXPERIMENTAL WORK AND EMBODIMENT OF THE INVENTION

Cold-rolled steel sheet samples 0.8 mm in thickness were degreased and pickled by the conventional procedures and were electroplated at a coating weight of 15 g/m$^2$ using plating baths having compositions shown in Table 1 (Only in the test run using Comparative Bath No. 3, the coating weight was 30 g/m$^2$.) The Zn source was zinc sulfate, the Ni source was nickel sulfate, the Co source was cobalt sulfate, Ti source was potassium titanium fluoride, the Al source was aluminum sulfate and the Mg source was magnesium sulfate.

The electroplating was carried out with the current density of 20 A/dm$^2$.

Separately, to Invention Bath No. 1 aluminum was added in various amounts, and the amount of codeposited titanium was determined by X-ray fluorescence analysis. The results are summarized in the attached drawing. The amount of deposited titanium is given as the intensity of X-ray fluorescence. As seen in the drawing, by addition of a small amount of aluminum, the amount of codeposited titanium is increased to 3–10 times the amount when no aluminum was added. It was confirmed that the amount of codeposited titanium is increased by addition of magnesium as well.

Most of the electroplated steel sheet samples obtained as mentioned above were heated under the conditions indicated in Table 1.

The samples were subjected to corrosion test and corrosion peeling test. The corrosion test was carried out in accordance with the method of JIS (Japanese Industrial Standards) Z-2371 and in the salt spray test corrosion weight loss was measured at time intervals as indicated in the table and time until red rust was generated was determined. The corrosion peeling test was carried out as follows. Test pieces were kept in an atmosphere of 70° C. and 98% relative humidity for 96 hours, and thereafter, each test piece was bent in the U shape with two pieces of the steel sheets of the same thickness inserted therebetween and an adhesive tape was applied to the bent portion and peeled off therefrom. Whether the plated layer was removed with the tape or not was observed. The results are summarized in Table 2. Sample No. 1 was plated using Bath No. 1, Sample No. 2 was plated using Bath No. 2, and so on.

TABLE 1

| Plating Bath | | Composition & pH of Bath $Zn^{2+}$ (g/l) | $Ni^{2+}$ (g/l) | $Co^{2+}$ (g/l) | $Ti^{4+}$ (g/l) | $Al^{3+}$ (g/l) | $Mg^{2+}$ (g/l) | PH | Heating After Plating: Hot Water (100° C.) | Heating After Plating: Steam (180° C.) |
|---|---|---|---|---|---|---|---|---|---|---|
| Invention Baths | 1 | 10 | 15 | 0.3 | 0.5 | 0.4 | — | 2.3 | 40 sec. (immersion) | — |
| | 2 | 20 | 48 | 2 | 4 | 0.9 | — | 2.2 | 10 sec. (immersion) | — |
| | 3 | 30 | 70 | 3 | 7 | 1.5 | — | 1.7 | " | — |
| | 4 | 35 | 140 | 5 | 10 | 4 | — | 1.5 | — | 20 sec. |
| | 5 | 30 | 70 | 3 | 2 | — | 0.5 | 2.0 | 10 sec. (immersion) | — |
| | 6 | 30 | 70 | 3 | 7 | — | 3 | 1.6 | — | 30 sec. |
| | 7 | 30 | 70 | 3 | 7 | 1.5 | — | 2.0 | — | — |
| Comparative Baths | 1 | 20 | 48 | — | — | — | — | 2.2 | — | — |
| | 2 | 30 | 70 | — | — | — | — | 1.8 | — | — |
| | 3 | 30 | 70 | — | — | — | — | 1.8 | — | — |

TABLE 2

| Sample | | Coating Weight g/m² (one side) | Composition of Plated Layer Ni | Co | Ti | Mg | Al | Zn | Corrosion Weight Gain (mg/dm²) After 144 hr | After 240 hr | After 336 hr | After 432 hr | Time up to Generation of Red Rust (hr) | Corrosion Peeling |
|---|---|---|---|---|---|---|---|---|---|---|---|---|---|---|
| Invention Samples | 1 | 15 | 10 | 0.05 | 0.008 | — | 0.003 | Balance | 31 | 34 | 45 | 59 | 312 | None |
| | 2 | " | 11 | 0.15 | 0.2 | — | 0.1 | " | 24 | 29 | 37 | 46 | 336 | " |
| | 3 | " | 12 | 0.35 | 0.4 | — | 0.3 | " | 20 | 25 | 30 | 38 | 384 | " |
| | 4 | " | 12 | 0.50 | 0.8 | — | 1.7 | " | 23 | 26 | 32 | 38 | 384 | Slight |
| | 5 | " | 12 | 0.40 | 0.03 | 0.003 | — | " | 36 | 39 | 46 | 63 | 312 | None |
| | 6 | " | 12 | 0.28 | 0.4 | 0.4 | — | " | 27 | 34 | 48 | 65 | 336 | " |
| | 7 | " | 12 | 0.40 | 0.3 | — | 0.1 | " | 35 | 41 | 54 | 89 | 288 | Slight |
| Comparative Samples | 1 | " | 11 | — | — | — | — | " | 53 | 50 | 91 | 176 | 144 | Remarkable |
| | 2 | " | 12 | — | — | — | — | " | 38 | 43 | 85 | 150 | 144 | " |
| | 3 | 30 | 12 | — | — | — | — | " | 31 | 37 | 56 | 92 | 312 | Slight |

As apparent from Table 2, the electroplated steel sheets obtained in accordance with this invention are superior to those of the conventional process in corrosion resistance and corrosion peeling even at light coating weight such as 15 g/m².

As has been described above, this invention makes it possible to increase codeposition of titanium which improves corrosion resistance of Zn-Ni-alloy-electroplated layers, to inhibit generation of pin holes and to seal pin holes if generated. Thus corrosion resistance and corrosion peeling resistance are remarkably improved and the coating weight can be substantially reduced. It was confirmed that Zn-Ni-alloy-electroplated steel sheets with coating weight of 10 g/m² in accordance with this invention have corrosion resistance equal to conventional Zn-Ni-alloy-electroplated steel sheets with coating weight of 20 g/m².

We claim:

1. A process for preparing zinc-alloy-electroplated steel sheets excellent in corrosion resistance comprising electroplating steel sheets with an aqueous acidic plating bath containing 10–40 g/l (gram as atom per liter bath) zinc, 15–160 g/l nickel, 0.2–10 g/l titanium, 0.1–5 g/l cobalt and 0.1–5 g/l aluminum or 0.2–4 g/l magnesium, the pH of which is 1.5–2.5.

2. The process as recited in claim 1, wherein the bath contains 12–25 g/l zinc, 20–60 g/l nickel, 1–8 g/l titanium, 0.5–3 g/l cobalt, 0.15–3 g/l aluminum ions or 0.3–3 g/l magnesium ions.

3. The process as recited in claim 2, wherein the bath contains 13–21 g/l zinc, 30–50 g/l nickel, 3–7 g/l titanium, 1–2 g/l cobalt, 0.2–2 g/l aluminum, or 0.5–2 g/l magnesium.

4. The process as recited in claim 1, wherein zinc chloride, sulfate, nitrate, or acetate is used as the zinc source; nickel chloride, sulfate, nitrate, or acetate is used as the nickel source; titanium tartarate, titanium oxalate, sodium titanate fluoride or potassium titanium fluoride is used as the titanium source; cobalt chloride, sulfate, nitrate or acetate is used as the cobalt source; aluminum chloride, sulfate, nitrate or acetate is used as the aluminum source; and magnesium chloride, sulfate, nitrate or acetate is used as the magnesium source.

5. The process as recited in claim 4, wherein the zinc sulfate is used as the zinc source, nickel sulfate is used as the nickel source, cobalt sulfate is used as the cobalt source, sodium or potassium titanium fluoride is used as the titanium source, and aluminum sulfate or magnesium sulfate is used as the source of aluminum or magnesium.

6. The process as recited in any one of claims 1 through 5, wherein an electroplated layer comprising 8–16% by weight nickel, 0.005–1% by weight titanium, 0.01–0.5% by weight cobalt, 0.001–2% by weight aluminum or 0.001–1% by weight magnesium, and the balance zinc is deposited.

7. The process as recited in any one of claims 1 through 5, wherein the electroplated layer is heated in an atmosphere of 60°–200° C.

8. The process as recited in claim 7, wherein the atmosphere is hot water, steam or atomized water mist atmosphere.

9. The process as recited in any one of claims 1 through 5, wherein the electroplating is carried out with a current density of 5–150 A/dm².

10. The process as recited in claim 9, wherein electroplating is carried out with a current density of 10–100 A/dm².

11. The process as recited in claim 10, wherein electroplating is carried out with a current density of 20–80 A/dm².

12. A product according to the process of claim 1.

13. A process for preparing zinc-alloy electroplated steel sheets excellent in corrosion resistance comprising electroplating steel sheets with an aqueous acidic plating bath, the pH of which is 1.5–2.5, said bath comprising 10–40 g/l (gram as atom per liter bath) zinc, 15–160 g/l nickel, 0.2–10 g/l titanium and a sufficient amount of an ion comprising an element which enhances the codeposit of titanium during electroplating.

14. A process according to claim 13 wherein the ion selected for enhancing codeposit of titanium contains a metal selected from the group aluminum, magnesium, iron and boron.

15. A product according to the process of claim 13.

* * * * *